US005409577A

United States Patent [19]

Tratz et al.

[11] Patent Number: 5,409,577

[45] Date of Patent: Apr. 25, 1995

[54] CARBONIZATION APPARATUS

[75] Inventors: Herbert Tratz, Ottensoos; Karl May, Bad Vilbel, both of Germany

[73] Assignee: Siemens Aktiengesellschaft, Munich, Germany

[21] Appl. No.: 45,895

[22] Filed: Apr. 12, 1993

[30] Foreign Application Priority Data

Apr. 13, 1992 [DE] Germany ..... 42 12 376.3
Apr. 13, 1992 [DE] Germany ..... 42 12 377.1

[51] Int. Cl.[6] ..... C10B 1/06; C10B 53/00

[52] U.S. Cl. ..... 202/226; 282/262; 201/7

[58] Field of Search ..... 202/226, 262, 270; 241/176, 181, 183; 83/923; 201/7, 21, 25, 32

[56] References Cited

U.S. PATENT DOCUMENTS 1,664,723 4/1928 Young ..... 201/7
3,224,839 12/1965 Pierson ..... 241/181
3,794,565 2/1974 Bielski et al. .
3,910,756 10/1975 Henning ..... 241/183
4,181,495 1/1980 Bernt .
4,205,613 6/1980 Fio Rito et al. .
4,301,750 11/1981 Fio Rito et al. .

FOREIGN PATENT DOCUMENTS 0086488 8/1983 European Pat. Off. .
1019828 11/1957 Germany .
2033535 1/1971 Germany .
2142766 3/1973 Germany .
2707698 8/1978 Germany .
2709671 9/1978 Germany .
2713031 12/1978 Germany .
1558030 4/1979 Germany .
2848485 9/1979 Germany .
2810838 10/1979 Germany .
3004385 8/1981 Germany .
3211249 12/1982 Germany .
3230390 6/1985 Germany .
3702318 1/1988 Germany .
3708224 9/1988 Germany .
3706771 12/1988 Germany .
3736084 5/1989 Germany .
3835451 4/1990 Germany ..... 201/25
138472 2/1920 United Kingdom .
1185892 3/1970 United Kingdom .
1576997 10/1980 United Kingdom .

*Primary Examiner*—Joye L. Woodard
*Attorney, Agent, or Firm*—Herbert L. Lerner; Laurence A. Greenberg

[57] ABSTRACT

A carbonization apparatus for carbonizing material which includes metal parts, as for instance waste material with elongated metal parts, such as metal wires and metal bands. A residue discharge pipe has a discharge port formed in an end face thereof. Carbonization residue is discharged through the discharge port. The residue discharge pipe rotates about its longitudinal axis. The metal parts are entrained with a device which is disposed in a region of the discharge port and which rotates with the residue discharge pipe. In the alternative, the entrainment device or devices are disposed inside a carbonization drum. A stationary bar-shaped member cooperates with the entraining device to tear the metal parts discharging from the discharge opening.

14 Claims, 4 Drawing Sheets

CARBONIZATION APPARATUS

BACKGROUND OF THE INVENTION

Field of the Invention

The invention relates to a carbonization apparatus, for carbonizing material which includes metal parts, particularly waste materials with metal wires or metal bands, wherein the carbonization apparatus includes a residue discharge pipe which is rotatable about its longitudinal axis and which has a discharge port at a face end thereof for discharging carbonization residues. The invention further relates to a carbonization drum of a carbonization apparatus which is rotatable about its longitudinal axis. The residue discharge pipe may be a part or a segment of the carbonization drum, or it may be a component which is connected to the carbonization drum.

A carbonization apparatus for carbonizing waste materials is known from German Published, Examined Patent Application 27 13 031. Waste materials are fed into a heated carbonization drum which is rotatable about its longitudinal axis. In the carbonization drum, the waste materials are carbonized to form carbonization gas and solid carbonization residue. The carbonization gas and carbonization residue leave the carbonization drum via a residue discharge pipe firmly joined to the carbonization drum and rotating therewith. From there, the carbonization gas reaches a carbonization gas line, while the solid carbonization residue drops downward into a discharge device. It may be adjoined by a transport system and/or a sorting device.

The waste materials to be carbonized may include metal wires or metal bands. Spirals, springs and similar metal parts may also be present in the waste. Such metal parts originate in steel-belted tires, Bowden cables, other cables, plastic composite materials, or electrical appliances, for instance. Once the waste materials have been introduced into the carbonization drum, the metal parts are exposed during the carbonization process. This is ascribed to the fact that at the temperatures of approximately 400° C. to 700° C. that prevail in a carbonization drum, most of the organic substances by which the metal parts are joined are carbonized. At those temperatures, metal is not destroyed. The metal parts, freed of plastic or rubber by the carbonization process, are matted together by the rotary motion of the carbonization drum. Particularly when relatively long wires, bands or spirals are present, a tangled rope forms in the carbonization drum during the carbonization process as a consequence of the rotary motion. That entanglement may extend over the entire length of the carbonization drum. The diameter of this tangled rope often amounts to approximately 20 to 30 cm, depending on the size of the drum and on the type of waste. Some metal parts, particularly steel casings from steel-belted tires and Bowden cables, are so stable that the resultant tangled rope does not break off even by the time it reaches the discharge port of the carbonization drum. The tangled rope then moves endlessly out of the carbonization drum and enters into the discharge device for carbonization residue. This may plug up the discharge device. It can also hinder the discharge of the remaining carbonization residue. If a transporting and sorting device is connected to the residue discharge device, the danger exists that the operation of these devices will be impeded by the tangled rope. Then the entire carbonization device would be shut down.

SUMMARY OF THE INVENTION

It is accordingly an object of the invention to provide a carbonization apparatus of the above-mentioned type which overcomes the hereinafore-mentioned disadvantages of the heretofore-known devices of this type and which make it impossible for a tangled mat formed of metal parts to hinder or even prevent the discharge of carbonization residue and/or the ensuing transporting and sorting of carbonization residue.

With the foregoing and other objects in view there is provided, in accordance with the invention, a carbonization apparatus for carbonizing material including metal parts, comprising a residue discharge pipe having a longitudinal axis and having a discharge port formed therein at an end face thereof for discharging carbonization residue, said residue discharge pipe being rotatable about said longitudinal axis; and entrainment means disposed in a region of said discharge port for entraining metal parts discharging from said discharge opening, said entrainment means being rotatable with said residue discharge pipe.

According to the invention, this object is attained on the one hand by disposing at least one, preferably bar-shaped entraining lug, which is rotatable with the residue discharge pipe, in the region of the discharge port.

Because of its weight, the tangled rope moves along the lowest point of the carbonization drum and of the residue discharge pipe. When the entraining lug encounters the tangled rope, the rope stays caught on the entraining lug and is lifted in the residue discharge pipe. Once the entraining lug has reached the highest point in the residue discharge pipe, the tangled mat drops to the bottom again. This mechanical strain loosens and separates the tangled rope, so that only individual tangled pieces then leave the residue discharge pipe. These pieces are so small that they cannot impede the further discharge of the solid residue and, if applicable, the sorting of the solid residue.

In accordance with an added feature of the invention, a bar-shaped member which is not rotatable with the residue discharge pipe is disposed below the residue discharge pipe, protruding axially beyond the end of the pipe at which the discharge port is located. A tangled rope that moves downward out of the discharge port is initially restrained by the bar. When the tangled rope is then lifted by the entraining lug, the piece of tangled mat between the entraining lug and the bar is stretched and as a result torn apart. The advantage is attained that even solidly matted material can be broken apart.

In accordance with another feature of the invention, a tearing device with a downwardly pointing tearing edge, which is not rotatable with the residue discharge pipe, is disposed in the region of the discharge port, in the vicinity of the ascending side of the rotatable residue discharge pipe. When the tangled rope is lifted by the entraining lug, it is pressed against the tearing edge and torn or cut thereby. Because the tearing edge is oriented downward, the torn-off matted pieces immediately drop downward and move into the discharge device.

As with the combination of a entraining lug and bar-shaped member, a tangled mat that is mechanically quite stable may be broken apart by the combination of the entraining lug and tearing device.

Any combination of the entraining lug, bar-shaped member and tearing device is also possible.

The entraining lug may be disposed upright in the residue discharge pipe, on its inner surface. It may also be disposed protruding from the residue discharge pipe beyond its discharge port. In both versions, the tangled rope is lifted. A plurality of preferably bar-shaped entraining lugs may also be present, disposed over the circumference of the residue discharge pipe.

The entraining lug may also be disposed such that it is inclined by an angle in the direction of rotation of the residue discharge pipe. This particularly effectively assures that the tangled rope will be carried along by the entraining lug. Particularly with a combination of the entraining lug and tearing device, it is assured that the tangled rope will encounter the tearing edge of the tearing device, because it is pressed against the wall of the residue discharge pipe by the inclined entraining lug.

In accordance with a further feature of the invention, the bar-shaped member, which does not rotate with the residue discharge pipe, is disposed at an angle sloping downward from the horizontal. As a result, torn-off pieces of tangled mat advantageously always slide off the bar. Pieces of the tangled mat cannot remain stuck to the bar.

In accordance with an additional feature of the invention, the tearing device takes the form of scissors opening downward. This has the advantage that the tangled rope, lifted by the entraining lug, cannot slide past the tearing device. Instead, it enters into the opening of the scissors, from where it cannot escape to the side, and is torn off.

The scissors may have an adjustable opening angle. As a result, the opening angle can be set such that the tangled rope is always optimally received by the scissors even when the tangled rope diameter varies.

The tearing device may be curved away from the discharge port, for instance, in the direction of the longitudinal axis of the residue discharge pipe. As a result, the tangled rope can readily be introduced.

In accordance with yet another feature of the invention, the tearing device is arranged to be movable in the direction of the longitudinal axis of the residue discharge pipe.

For instance, it may be embodied as a pendulum. It may be joined in pendulum-like fashion to a stationary system part above the discharge port via a pendulum arm. This has the advantage that even if pipe motions in the axial direction occur, the tearing device will always be disposed directly at the discharge port. This assures that the tangled rope can always be fed to the tearing device.

With the carbonization apparatus according to the invention, which has a tearing device for the material leaving the discharge port, the advantage is attained that a tangled rope of non-carbonizable material formed in the carbonization and particularly made up of metal wires and other metal waste cannot hinder or even block the discharge and sorting system for carbonization residues.

With objects of the invention in view, there is further provided, in accordance with the invention, an improvement in a carbonization apparatus for carbonizing material with metal parts, including a residue discharge pipe with a longitudinal axis and a discharge port formed in an end face thereof for discharging carbonization residue, the residue discharge pipe being rotatable about the longitudinal axis; the improvement comprises tearing means disposed in close proximity to the discharge opening for tearing material emerging from the discharge port.

There is also provided, in accordance with the invention, a carbonization apparatus for carbonizing material with metal parts, comprising: a carbonization drum having a longitudinal axis and being rotatable about said longitudinal axis; and entrainment means disposed in said carbonization drum for entraining metal parts, said entrainment means being rotatable with said carbonization drum.

In other words, there is disposed at least one entraining lug for a tangled rope formed of metal parts on the carbonization drum, and the at least one entraining lug is rotatable with the carbonization drum.

By way of example, the at least one entraining lug protrudes into the interior of the carbonization drum.

Due to the gravitational force acting on it, the tangled rope moves along the lowest point of the carbonization drum. When a entraining lug encounters the tangled rope, the rope catches on the entraining lug and is lifted in the carbonization drum. Because of the weight of the tangled rope, pieces of tangled mat are torn out by the entraining lug. The tangled rope breaks apart. Only individual matted pieces then leave the carbonization drum. These pieces are so small that they cannot impede the further discharge of the solid residue and if applicable the sorting of the solid residue.

The entraining lug or lugs are hooklike, for instance. As a result, the tangled rope can be readily lifted by the entraining lug. For that purpose, the hook is curved in such a way that it points upward on the ascending side of the rotating carbonization drum.

The at least one entraining lug is disposed in the hot region of the carbonization drum, for instance. It may also be disposed in some other region of the carbonization drum. In a carbonization drum, the hot region is located directly upstream of the exit of carbonization gas and residue. By disposing the entraining lug in the hot region, a mechanical separation of the tangled rope is advantageously performed in the place where the tangled rope is already impaired in terms of its material strength by the high temperature.

In accordance with another feature of the invention, the at least one entraining lug is secured to the inner shell surface of the carbonization drum. The entraining lug may also be secured to the inner surface of the carbonization drum via a holding device. The holding device may be long enough so as to assure that the entraining lug is located in an inner space in the carbonization drum which is free of fixtures. A carbonization drum may in fact contain fixtures that are located on the inner shell surface. Even if gaps remain between these fixtures, a tangled rope will not form in these gaps but instead will form on the fixtures towards the center of the carbonization drum. It is therefore advantageous if the entraining lug is disposed not on the inner surface of the carbonization drum but instead directly above the fixtures. Via the holding device, the entraining lug can be retained in this position.

By way of example, at least one additional entraining lug may be disposed on a flank of the holding device.

By means of entraining lugs staggered one after the other on a holding device, the tangled rope is gripped even better.

The holding device may for instance be a spike. This spike may be joined directly to the carbonization drum or to a device fixedly installed in the carbonization drum.

The holding device may also be a support bracket for heating pipes or for some other built-in part that is present in the carbonization drum anyway. The heating pipes extend along the inner surface of the carbonization drum and serve to heat it.

The holding device may in particular be a spike joined to a support bracket or, in other words, it may be a combination of a support bracket and a spike.

The at least one entraining lug may also be secured to a heating pipe fixedly installed in the carbonization drum, or to some other built-in part. It is appropriate to select one of the inner heating pipes for that purpose, so that the entraining lug will always protrude into the space free of fixtures in the carbonization drum.

The aforementioned positioning of the at least one entraining lug assures that the tangled rope will always encounter the entraining lug.

In accordance with yet a further feature of the invention, a plurality of entraining lugs are distributed over the length of the carbonization drum. As a result, the tangled rope is attacked simultaneously at several points so as to be torn apart even more dependably.

By way of example, the entraining lugs may be disposed in alignment with one another in an axial direction of the carbonization drum. In that case, they lift up the entire tangled rope at the same time.

In accordance with yet an additional feature of the invention, the entraining lugs are arranged in the direction of the axis of rotation and distributed over the inner circumference of the carbonization drum. As a result, as viewed along the length of the carbonization drum, a tangled rope can be lifted at various positions at various times. As a result, two adjacent entraining lugs may stretch the tangled rope, which increases the mechanical strain on the tangled rope and facilitates the tearing apart of the tangled rope.

By way of example, the entraining lugs are distributed in a spiral pattern, as viewed in the direction of the axis of rotation of the carbonization drum. With this structurally simple distribution, the tangled rope is lifted uniformly during one revolution.

With the carbonization apparatus according to the invention, which has a tearing device for the material located in the carbonization drum, the advantage is attained that a tangled rope of uncarbonizable material, particularly metal wires and other metal waste, forming in the carbonization process cannot hinder or even block a discharge device and a sorting device for carbonization residues.

With the objects of the invention in view, there is also provided an improvement in a carbonization apparatus for carbonizing material with metal parts, for example waste material with elongated metal parts such as wire and metal bands, the apparatus including a rotatable carbonization drum for carbonizing the material; the improvement comprises tearing means operatively associated with the carbonization drum for tearing the material, for instance metal wires and metal bands which have become entangled during a rotation of the carbonization drum.

Other features which are considered as characteristic for the invention are set forth in the appended claims.

Although the invention is illustrated and described herein as embodied in a carbonization apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings

DESCRIPTION OF THE PREFERRED EMBODIMENTS

Figure 1:
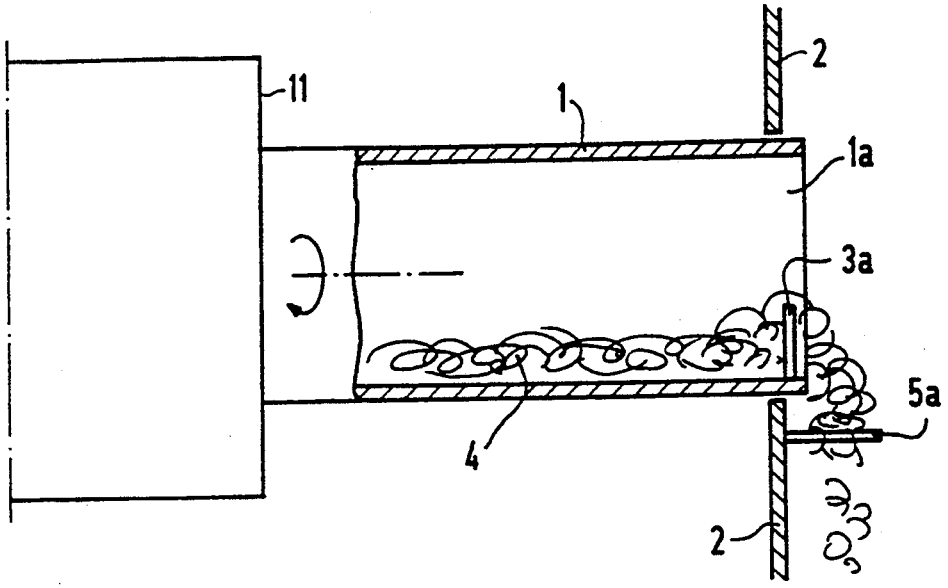
FIG. 1 is a diagrammatic side-elevational view, partly in section, of a rotatable residue discharge pipe of a carbonization apparatus, with a entraining lug disposed inside the pipe and rotating with the pipe, and a stationary bar not rotating with the pipe.

Referring now to the figures of the drawing in detail and first, particularly, to FIGS. 1–4 thereof, there is seen a residue discharge pipe 1 which forms part of a carbonization apparatus. Such an apparatus is known for instance from German published, examined patent application 27 13 031. The residue discharge pipe 1 may be joined firmly to a carbonization drum 11 and it can rotate, together with the carbonization drum 11, about its longitudinal axis. The residue discharge pipe 1 may also be part of the carbonization drum 11. Carbonization gas and solid carbonization residue are discharged through the residue discharge pipe 1. They reach a stationarily disposed residue housing or container 2 into which the residue discharge pipe 1 opens. The carbonization gas rises upward in the process, while the solid carbonization residue drops downward. In the drawing, only one wall of the residue housing 2 is shown.

A tangled mat or rope 4 of metal wires and other metal parts can form in the carbonization drum and can plug up the residue housing 2 and other system components disposed downstream.

In FIG. 1, a flat, preferably bar-shaped driver lug or entraining lug 3*a* is disposed radially on the inside of the residue discharge pipe 1, in the region of the discharge port 1*a*. A plurality of entraining lugs 3*a* may also be present, distributed over the inner circumference. The entraining lug 3*a* is disposed upright in the residue discharge pipe 1, on its inner surface, it is orthogonal with respect to a tangential on the inner, curved surface of the discharge pipe 1 and with respect to the longitudinal axis of the pipe. The entraining lug 3a lifts the tangled rope 4 at the frequency of rotation of the residue discharge pipe 1. As a result, the tangled rope 4 can be broken up into individual pieces. To promote this process, a clamp or bar 5a is disposed on the stationary residue housing 2, below the residue discharge pipe 1. The bar 5a protrudes axially beyond the end of the residue discharge pipe 1 at which the discharge port 1a is located. The tangled rope 4 is restrained by the bar 5a, for example, and at the same time lifted by the entraining lug 3a. As a result, the length of rope or mat between these two components is torn apart.

Figure 2:
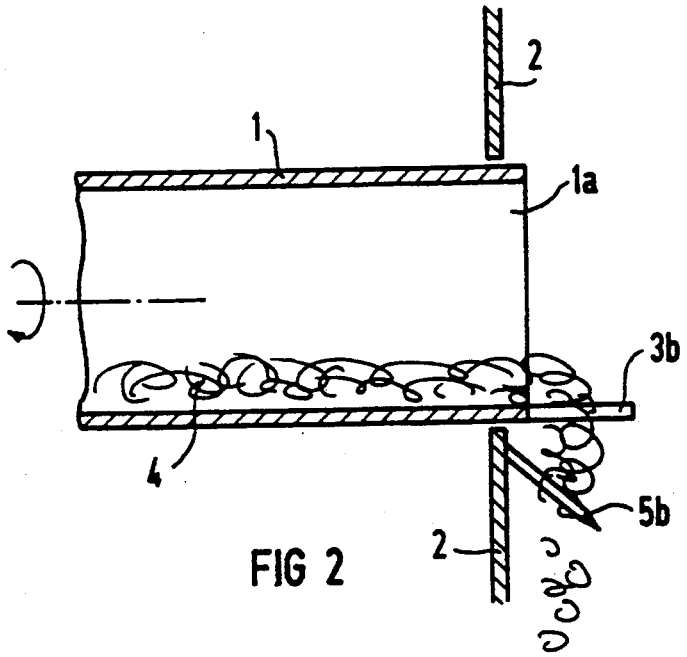
FIG. 2 is a similar view of a rotatable residue discharge pipe, with a entraining lug protruding from the residue discharge pipe and with a stationary bar extending obliquely downward.

In FIG. 2, a flat or preferably bar-shaped entraining lug 3b is disposed on the residue discharge pipe 1, protruding beyond its discharge port 1a, either substantially parallel to the longitudinal axis of the discharge pipe 1 or inclined in a direction of rotation. A bar 5b is inclined obliquely downward by an angle from the horizontal on the stationary residue housing 2. The tangled rope 4 is raised by the entraining lug 3b—in the same way as by the entraining lug 3a of FIG. 1. The tangled rope 4 may be torn through between the entraining lug 3b and the bar 5b. Since the bar 5b is inclined downwardly and forms an angle with the horizontal and with the longitudinal axis of the discharge pipe, severed pieces of the tangled rope 4 immediately slide off the bar 5b and drop downward.

An entraining lug that is not inclined may also be used, which is disposed in inclined fashion similarly to the entraining lug 3a or 3b, but at an angle to the generatrix of the residue discharge pipe 1 in its direction of rotation.

Any other combination of one of the aforementioned entraining lugs, such as the entraining lug 3a or 3b, and a bar 5a or 5b may be used as well.

Figure 3:
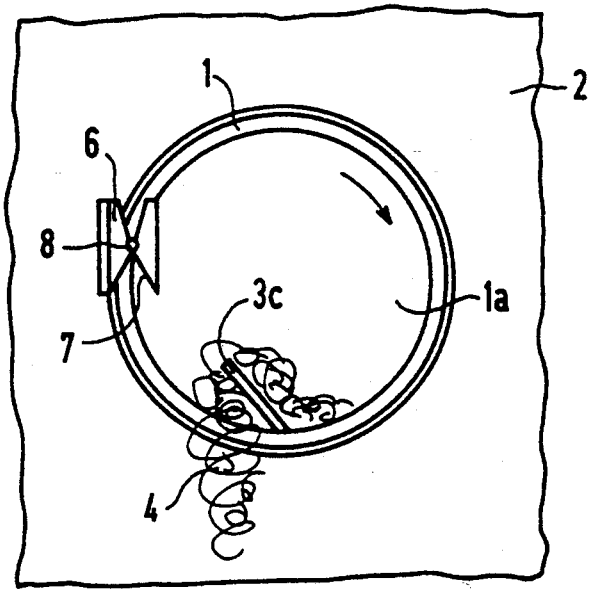
FIG. 3 is a front elevational view of a rotatable residue discharge pipe, with an entraining lug inclined inward and with a tearing device.

With reference to FIG. 3, a tearing device 6 with a downwardly pointing cutting or tearing edge 7 is disposed in the region of the discharge port la, at the ascending (left-hand) side of the residue discharge pipe 1, and just in front of the residue discharge pipe 1. The tearing device 6 is not rotatable with the residue discharge pipe 1. To that end, the tearing device 6 is for instance secured to the residue housing 2, only part of which is shown. A flat or preferably barlike entraining lug 3c is disposed upright on the inner surface of the residue discharge pipe 1, inclined at an angle in the direction of rotation of the residue discharge pipe 1. The direction of rotation is indicated by an arrow. With the residue discharge pipe 1 in rotation, a tangled rope 4 is engaged by the entraining lug 3c, fed to the tearing device 6, and severed at the tearing edge 7. This process is repeated with the frequency of the rotary motion of the residue discharge pipe 1. Instead of the entraining lug 3c, a radially disposed entraining lug 3a (FIG. 1) or an entraining lug 3b disposed in the longitudinal direction of the residue discharge pipe 1 (FIG. 2) may be used. The latter, of course, only as long as the entraining lug protrudes only as far from the discharge port 1a as it does not touch the tearing device 6 during the rotary motion of the residue discharge pipe 1.

All the entraining lugs 3a, 3b, 3c described thus far may be used in any embodiment of the carbonization apparatus. The tearing device 6 may take the form of scissors that open downward. This assures that the tangled rope 4 cannot slide off the tearing edge 7. The opening angle of the scissors-like tearing device 6 may be adjustable. To that end, the tearing device 6 is made up of two blades which are joined together via a swivel joint 8. The adjustable tearing device 6 may be adapted to the diameter of the tangled rope 4.

Figure 4:
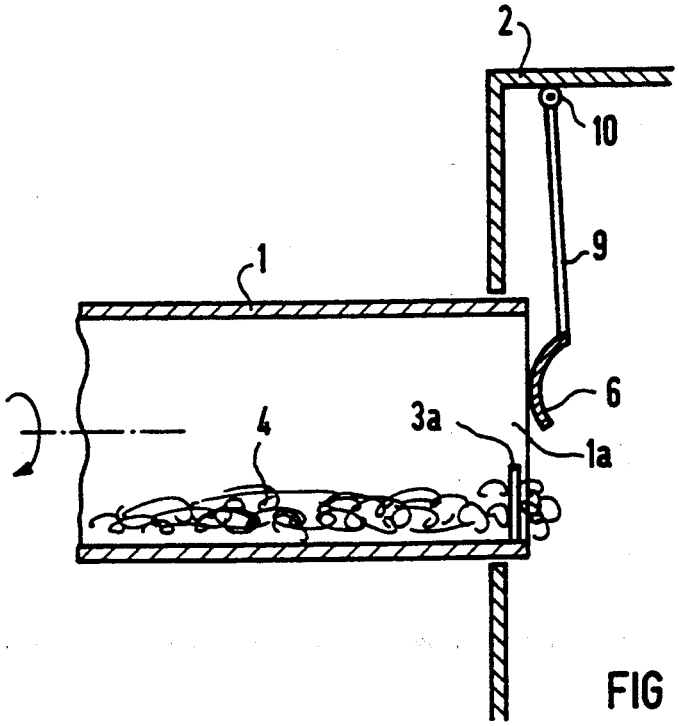
FIG. 4 is a view similar to FIG. 1 of the rotatable residue discharge pipe, with a tearing device which is pivotable in a direction of a longitudinal axis of the pipe.

In FIG. 4, a tearing device 6 is joined to the residue housing 2 via a pendulum arm 9. A pivot point 10 of the pendulum is positioned such that the tearing device 6, which may be curved with a curvature whose radius points away from the discharge port, always rests on the end face of the residue discharge pipe 1. The pivot point 10 is located above the discharge port 1a of the residue discharge pipe 1. If the tearing device is straight, the pivot point 10 is located on the left above the discharge opening 1a. If the tearing device 6 is curved (FIG. 4), the pivot point 10 may be located slightly to the right above the discharge port 1a. This assures that the tearing device 6 will always rest with a certain force on the end face of the residue discharge pipe 1. Axial pipe movement towards the left should not be expected. In the event of axial pipe movement towards the right, for instance as a result of thermal expansion of the residue discharge pipe 1, the pendulum, made up of the pendulum arm 9 and the tearing device 6, will be deflected toward the right, i.e. counter-clockwise. Given the expansion of the residue discharge pipe 1 to be expected, the tearing device 6 will always rest on the end face of the residue discharge pipe 1.

This assures that the tearing device 6 will always assume the correct position so that it is capable of severing a tangled rope 4, when the rope is lifted by an entraining lug 3a.

With the embodiments of the carbonization apparatus according to the invention as shown in FIGS. 1–4, a tangled rope 4 at the outlet from the residue discharge pipe 1 can be broken apart into individual relatively small pieces. Consequently, the further treatment of the solid residue is not impaired.

Figure 5:
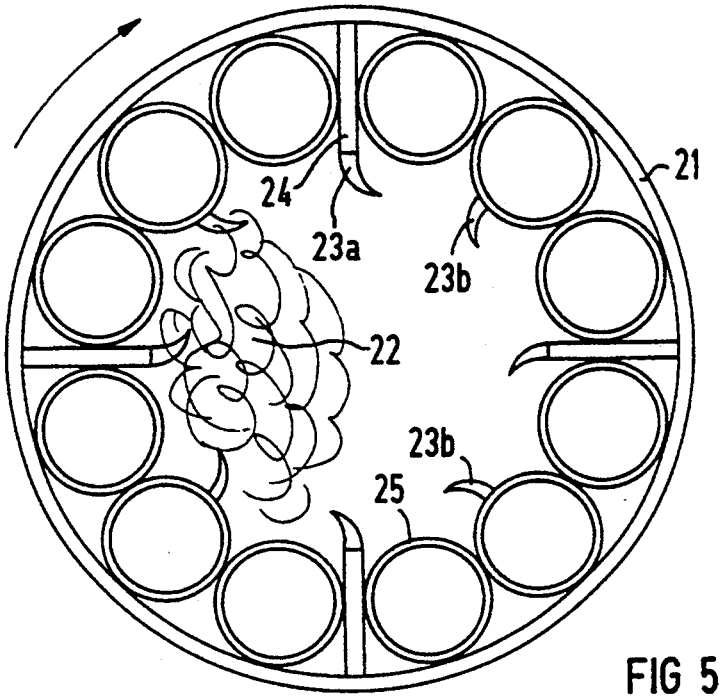
FIG. 5 is a sectional view through a carbonization drum of a carbonization apparatus of a second embodiment of the invention, with heating pipes and with entraining lugs disposed on spikes or on the heating pipes.

In FIG. 5, a plurality of entraining lugs 23a for the tangled rope 22 are disposed in the carbonization drum 21 itself. They are joined to the inner surface of the carbonization drum 21 via straight spikes 24. The spikes 24 are necessary so that the entraining lugs 23a will be located in the fixture-free interior space of the carbonization drum 21. The fixtures in the carbonization drum 21 may be heating pipes 25. It is also possible for a plurality of entraining lugs 23b to be secured directly to the heating pipes 25, as long as it is assured that the entraining lugs 23b will protrude into the fixture-free interior space of the carbonization drum 21. The entraining lugs 23a, 23b, as seen while they are located in the ascending part of the carbonization drum 21, are bent upward in hooklike fashion. In other words, they are bent with a certain curvature, and the radius of curvature points in a direction of rotation. The direction of rotation of the carbonization drum 21 is indicated by an arrow.

Figure 6:
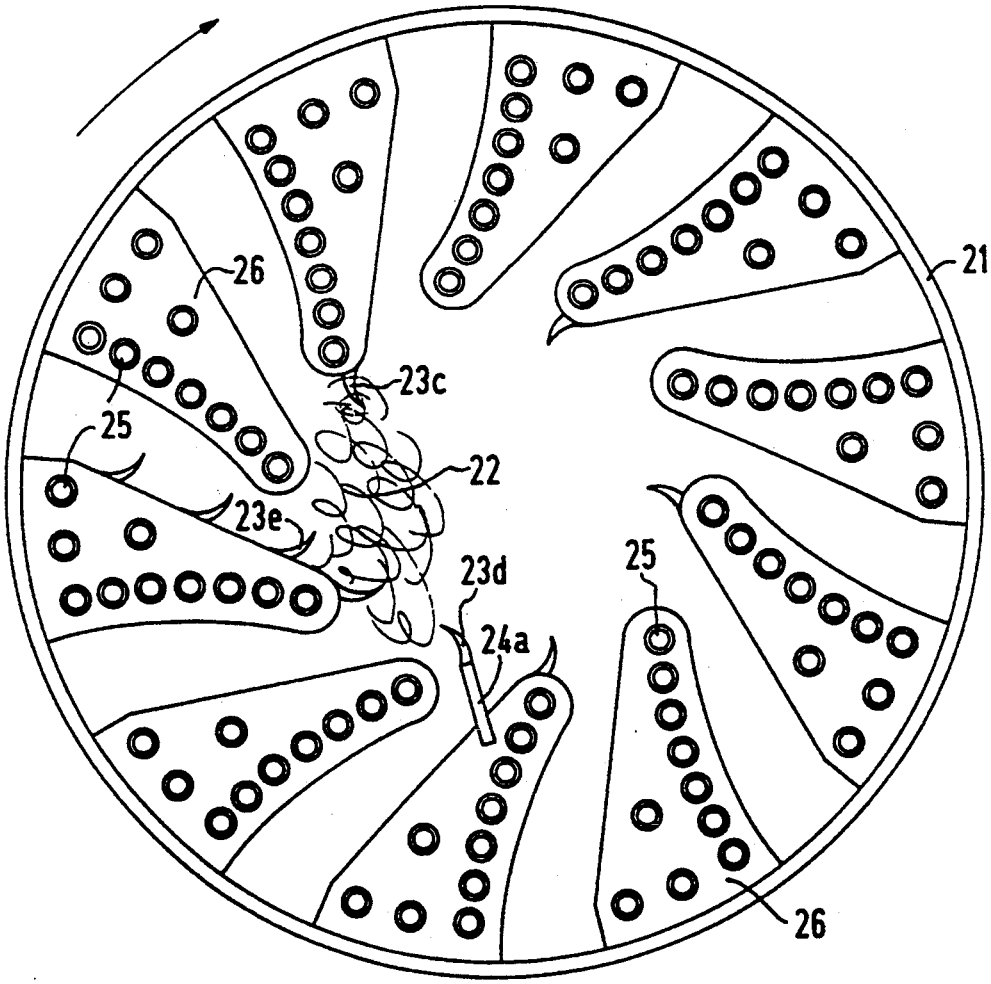
FIG. 6 is a similar view with support brackets and heating pipes, and with entraining lugs held directly and/or indirectly on support brackets.

The same effect is attained with the carbonization apparatus of FIG. 6. There, each entraining lug 23c is disposed on the portion of a support bracket 26 located closest to the center of the carbonization drum 21. The support bracket 26 has a plurality of heating pipes 25. An entraining lug 23d may also be disposed on each spike 24a, which is supported on a support bracket 26.

At least one additional entraining lug 23e may be disposed on the flank of the support bracket 26 or of some other holding device. As a result, the tangled rope 22 can be gripped even better.

Figure 7:
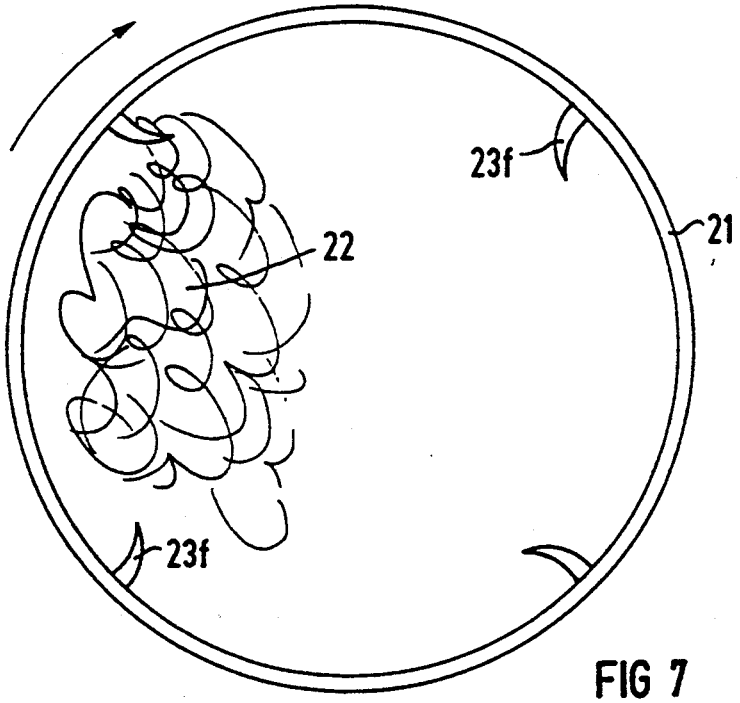
FIG. 7 is a similar view of the second embodiment, with entraining lugs disposed on the inside wall of the carbonization drum.

In FIG. 7, there are no fixtures contained in the carbonization drum 21. Entraining lugs 23f are therefore secured to the inner shell surface of the carbonization drum 21. This kind of carbonization drum 21 may be heated from outside.

The entraining lugs 23*a–d*, 23*f* are always located in the fixture-free interior space of the carbonization drum 21. Experience teaches that the tangled rope 22 does not form between fixtures but rather always in the space which is free of fixtures. The fixtures may be heating pipes 25, support brackets 26, or other devices disposed in the carbonization drum 21.

The holding device for an entraining lug 23*a–e* may be a holding device 24 or 24*a* specifically constructed for that purpose. However, fixtures already present in the drum, such as the support brackets 26 or other suitable fixtures, may also serve as holding devices.

Each hooklike entraining lug 23*a–f* is curved in such a way that it is curved upward on the ascending side when the carbonization drum 21 is rotating. As a result, it optimally engages the tangled rope 22, lifts it, and lets it drop downward from the highest point of the carbonization drum 21. The tangled rope 22 is torn apart by the mechanical strain. The entraining lugs 23*a–*23*f* may therefore also be referred to as tearing devices.

With the embodiments of the carbonization apparatus according to the invention shown in FIGS. 5–7, a tangled rope 22 in the carbonization drum 21 can be torn apart into individual pieces that cannot impair the further treatment of the solid residue.

While the foregoing description makes reference to two embodiments of the invention, i.e. FIGS. 1–4 and FIGS. 5–7, it should be understood that the two embodiments may be simultaneously employed, if so desired.

We claim:

1. A carbonization apparatus for carbonizing material including metal parts, comprising:

carbonization means;

a residue discharge pipe communicating with said carbonization means, said residue discharge pipe having a longitudinal axis and having a discharge opening formed therein at an end face thereof for discharging carbonization residue, and means for rotating said residue discharge pipe about said longitudinal axis; and entrainment means disposed in a region of said discharge opening for entraining metal parts discharging from said discharge opening, said entrainment means being rotatable with said residue discharge pipe; and a stationary bar-shaped member disposed in close proximity to and below said discharge opening, said bar-shaped member protruding axially beyond the end face of said residue discharge pipe in which said discharge opening is formed, said bar-shaped member and said entrainment means cooperating to tear the metal parts discharging from said discharge opening.

2. The carbonization apparatus according to claim 1, wherein said entrainment means are formed of at least one bar-shaped entraining lug rigidly attached to said residue discharge pipe in the region of said residue discharge opening.

3. The carbonization apparatus according to claim 2, wherein said at least one bar-shaped entraining lug is disposed on an inner wall surface of said residue discharge pipe and points radially inward.

4. The carbonization apparatus according to claim 2, wherein said at least one bar-shaped entraining lug is disposed on an inner wall surface of said residue discharge pipe and pointing inwardly and forming an angle relative to the longitudinal axis of said residue discharge pipe.

5. The carbonization apparatus according to claim 1, wherein said bar-shaped member points downwardly and forms an angle relative to said longitudinal axis.

6. The carbonization apparatus according to claim 1, wherein said carbonization means comprise a rotatable carbonization drum.

7. A carbonization apparatus for carbonizing material including metal parts, comprising:

carbonization means;

a residue discharge pipe communicating with said carbonization means, said residue discharge pipe having a longitudinal axis and having a discharge opening formed therein at an end face thereof for discharging carbonization residue, and means for rotating said residue discharge pipe about said longitudinal axis; and entrainment means disposed in a region of said discharge opening for entraining metal parts discharging from said discharge opening, said entrainment means being rotatable with said residue discharge pipe; and means disposed in close proximity to said discharge opening for tearing the metal parts being entrained by said entrainment means rotating with said discharge pipe, said tearing means being not rotatable with said residue discharge pipe and including a tearing edge pointing downwardly and being disposed at an ascending side of said rotatable discharge pipe.

8. A carbonization apparatus for carbonizing material including metal parts, comprising:

carbonization means;

a residue discharge pipe communicating with said carbonization means, said residue discharge pipe having a longitudinal axis and having a discharge opening formed therein at an end face thereof for discharging carbonization residue, and means for rotating said residue discharge pipe about said longitudinal axis; and entrainment means in the form of at least one bar-shaped entraining lug rigidly attached to said residue discharge pipe in the region of said residue discharge opening for entraining metal parts discharging from said discharge opening; wherein said at least one bar-shaped entraining lug is disposed on an inner wall surface of said residue discharge pipe, protruding outward of said residue discharge pipe beyond said discharge port.

9. The carbonization apparatus according to claim 8, wherein said carbonization means comprise a rotatable carbonization drum.

10. A carbonization apparatus for carbonizing material including metal parts, comprising:

carbonization means;

a residue discharge pipe communicating with said carbonization means, said residue discharge pipe having a longitudinal axis and having a discharge opening formed therein at an end face thereof for discharging carbonization residue, and means for rotating said residue discharge pipe about said longitudinal axis;

entrainment means disposed in a region of said discharge opening for entraining metal parts discharging from said discharge opening, said entrainment means being rotatable with said residue discharge pipe; and tearing means disposed in close proximity to said discharge opening for tearing the metal parts being entrained by said entrainment means rotating with said discharge pipe, said tearing means being not rotatable with said residue discharge pipe and including a tearing edge pointing downwardly and being disposed at an ascending side of said rotatable discharge pipe; wherein said tearing means are in the form of downwardly opening scissors.

11. The carbonization apparatus according to claim 10, wherein said scissors define an opening angle, and including means for adjusting said opening angle.

12. A carbonization apparatus for carbonizing material including metal parts, comprising:

carbonization means;

a residue discharge pipe communicating with said carbonization means, said residue discharge pipe having a longitudinal axis and having a discharge opening formed therein at an end face thereof for discharging carbonization residue, and means for rotating said residue discharge pipe about said longitudinal axis;

entrainment means disposed in a region of said discharge opening for entraining metal parts discharging from said discharge opening, said entrainment means being rotatable with said residue discharge pipe; and tearing means disposed in close proximity to said discharge opening for tearing the metal parts being entrained by said entrainment means rotating with said discharge pipe, said tearing means being not rotatable with said residue discharge pipe and including a tearing edge pointing downwardly and being disposed at an ascending side of said rotatable discharge pipe; wherein said tearing means are curved with a radius of curvature pointing away from said discharge port in a direction of said longitudinal axis of said residue discharge pipe.

13. A carbonization apparatus for carbonizing material including metal parts, comprising:

carbonization means;

a residue discharge pipe communicating with said carbonization means, said residue discharge pipe having a longitudinal axis and having a discharge opening formed therein at an end face thereof for discharging carbonization residue, and means for rotating said residue discharge pipe about said longitudinal axis;

entrainment means disposed in a region of said discharge opening for entraining metal parts discharging from said discharge opening, said entrainment means being rotatable with said residue discharge pipe;

tearing means disposed in close proximity to said discharge opening for tearing the metal parts being entrained by said entrainment means rotating with said discharge pipe, said tearing means being not rotatable with said residue discharge pipe and including a tearing edge pointing downwardly and being disposed at an ascending side of said rotatable discharge pipe; and means for supporting said tearing means so as to allow movement of the tearing means in a direction of said longitudinal axis of said residue discharge pipe.

14. The carbonization apparatus according to claim 13, wherein said supporting means comprises a pivotal pendulum arm.

* * * * *